US008786426B2

(12) United States Patent
Rosetti et al.

(10) Patent No.: US 8,786,426 B2
(45) Date of Patent: Jul. 22, 2014

(54) SYSTEM FOR MONITORING OPERATING FUNCTIONS OF RAILWAY DEVICES

(75) Inventors: Valerio Rosetti, Bologna (IT); Diego Marino, Bologna (IT)

(73) Assignee: Alstom Transport SA, Levallois-Perret (FR)

( * ) Notice: Subject to any disclaimer, the term of this patent is extended or adjusted under 35 U.S.C. 154(b) by 330 days.

(21) Appl. No.: 13/272,188

(22) Filed: Oct. 12, 2011

(65) Prior Publication Data

US 2012/0091288 A1 Apr. 19, 2012

(30) Foreign Application Priority Data

Oct. 18, 2010 (EP) ..... 10187958

(51) Int. Cl.
*G08B 21/00* (2006.01)
*B61L 27/00* (2006.01)

(52) U.S. Cl.
CPC ..... *B61L 27/0088* (2013.01)
USPC ..... 340/538; 246/217; 246/473 R

(58) Field of Classification Search
USPC ..... 340/538, 635, 679, 331; 246/217, 246/473 R, 415 R
See application file for complete search history.

(56) References Cited

U.S. PATENT DOCUMENTS

| | | | |
|---|---|---|---|
| 3,713,148 | A | 1/1973 | Cardullo et al. |
| 2004/0119587 | A1 | 6/2004 | Davenport et al. |

FOREIGN PATENT DOCUMENTS

| | | |
|---|---|---|
| DE | 10023093 | 12/2001 |
| DE | 10 2005 043305 | 3/2007 |
| DE | 10 2006 017628 | 10/2007 |
| EP | 0957020 | 11/1999 |
| EP | 1081011 | 3/2001 |
| EP | 1258412 | 11/2002 |
| EP | 1552998 | 7/2005 |
| EP | 1860893 | 11/2007 |
| EP | 2236389 | 10/2010 |
| FR | 2745543 | 5/1997 |

OTHER PUBLICATIONS

EP Search Report for Application No. 10187958.3 filed on Oct. 18, 2010 in the name of Alstom Transport SA.

*Primary Examiner* — Jeffery Hofsass
(74) *Attorney, Agent, or Firm* — Steinfl & Bruno LLP

(57) ABSTRACT

A system for monitoring operating functions of railway devices such as switch machines of turnouts and signal lamps is described. The system comprises a wireless network for communication among operating parameter local detection units associated to individual railway devices and a data collection server and/or remote portable units. The local units detecting operating parameters can be powered via power lines of a railway device to be monitored and for a period of time during which a power signal powering the monitored railway device is provided.

20 Claims, 5 Drawing Sheets

SYSTEM FOR MONITORING OPERATING FUNCTIONS OF RAILWAY DEVICES

CROSS REFERENCE TO RELATED APPLICATIONS

The present application claims priority to European Patent Application No. 10187958.3, filed on Oct. 18, 2010, which is incorporated herein by reference in its entirety

FIELD

The present disclosure relates to monitoring systems. In particular, it relates to a system for monitoring operating functions of railway devices.

BACKGROUND

The present disclosure relates to a system for monitoring operating functions of railway devices. For example, the railway devices may include but are not limited to switch machines of turnouts and signal lamps, the system comprising a network for communication among operating parameter local detection units associated to the individual devices and a data collection server and/or remote portable units.

The above-mentioned type of systems are known and are widely used for remotely monitoring operation of devices arranged along railway lines, especially devices that are particularly crucial for safety purposes, for example those which cause a specific vital control to be performed such as switch machines of turnouts, in order to readily take corrective actions in case of malfunctions and/or to schedule suitable maintenance services. The document FR2745543 describes a system of this type wherein a central remote monitoring unit receives, by means of local acquisition units, data relating to operating parameters of devices arranged along a railway line detected by a sensor network.

Even though such systems accomplish their task, they are very complex since a direct connection between each sensor and a corresponding local acquisition unit is required, the latter often being arranged several meters away. Moreover the above-mentioned systems use transducers, such as thermocouples, accelerometers, and Hall Effect sensors, which indirectly measure operating parameters of devices of interest instead of directly measuring the operating electrical parameters of such devices. On the other hand it is desirable to remotely measure electrical operating parameters of railway devices such as switch machines of turnouts, signals, and track circuits as this allows not only an immediate confirmation of the operation of the device of interest to be provided, but also allows information about a possible future malfunction thereof to be provided. For example, detection of an anomalous power consumption within a switch machine of a turnout will not necessarily cause the switching control to fail immediately, but may be a sign of malfunction that may cause a serious failure to occur in time.

The document EP 1081011 describes an electrical unit intended for detecting electrical parameters relating to an operation of apparatuses arranged along railway lines; for measuring such parameters and transmitting signals; and relating measurements thus obtained, to calculated control groups. However, the electrical unit is fitted on a terminal block placed into suitable signaling cabinets arranged remotely with respect to the devices to be monitored and connected thereto by long electrical cables. Therefore even the above-mentioned system is very complex with respect to cabling. Moreover, measuring devices, even if designed not to influence monitored devices, can affect their operation, particularly in case of failures due to the provision of cables that can convey interferences which in themselves can cause incorrect operations to occur.

SUMMARY

According to one aspect of the disclosure, a system for monitoring operating functions of railway devices is described comprising a network for communication among operating parameter local detection units associated to individual railway devices, and a data collection server and/or remote portable units, wherein the network is a wireless network and the local detection units detecting operating parameters are powered via power lines of the railway device to be monitored and for a period of time during which a power signal powering the monitored railway device is provided.

The details of one or more embodiments of the disclosure are set forth in the accompanying drawings and the description below. Other features, objects, and advantages will be apparent from the description and drawings, and from the claims.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION

Figure 1:
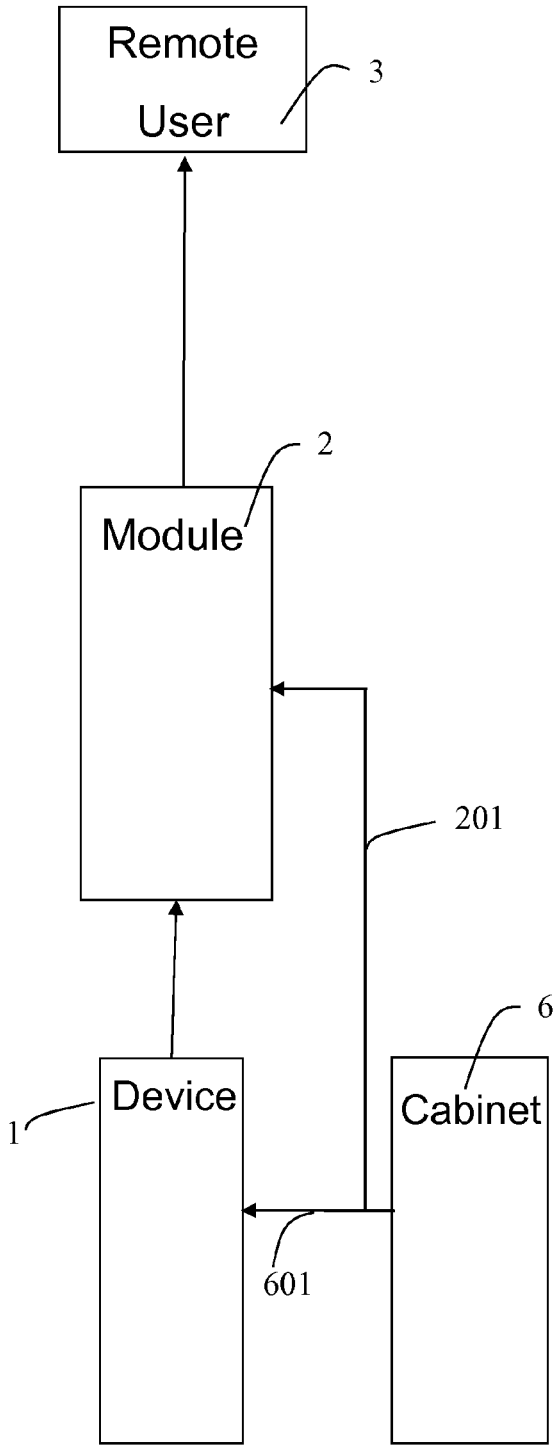
FIG. 1 is exemplary of the operating principle of embodiments of the present disclosure.

The present disclosure provides a system wherein a communication network is a wireless network and local units detecting operating parameters are powered via power lines of a device to be monitored and for a period of time during which a power signal powering the monitored device is provided.

By using a wireless communication network according to some embodiments of the disclosure, it is possible not only to effectively monitor operating parameters of devices without using cables, but also interferences among detection units and monitored devices which may cause undesired and casual operations. A system according to some embodiments of the present disclosure provides measuring and detecting apparatuses which are not independent apparatuses with respect to the devices with which they are interfaced, rather they are an integral part thereof and are able to operate only if the corresponding device is operating. This dependence of measuring and detecting apparatuses on the corresponding devices may reduce a period of time during which operating parameters can be monitored, however it can provide that any interferences on power lines of detection units and/or sensors will not affect the operation of the underlying devices.

In some embodiments, the detection units are powered only when the monitored devices are powered.

According to one embodiment, each detection unit can monitor a device and each unit can be powered only if the corresponding monitored device is powered.

According to another embodiment, the detection units are powered by the same power signal powering the devices.

The detection units can detect and/or transmit parameters during the whole period in which the monitored device is in operation or they can operate during a specific phase of the operation, for example at the beginning or the end of an execution of a specific operating command. In particular it is possible to provide operating parameters to be read and/or detected continuously, in which case the transmission can occur only during a set period, after switching off the power supply, for example when the power supply is switched on again after executing a specific operating command. To this end, detection units can comprise storage elements for storing operating parameters such that they can be transmitted at a set time.

In some embodiments, detection units can be provided with an interface to the corresponding device to be monitored and with means for transmitting detected parameters. The means for transmitting detected parameters may include but are not limited to a transmission module and an antenna. In some embodiments the interface is serial towards a port where the device makes parameters of interest available.

In one embodiment, both the interface and transmission means can be powered by power lines of the device to be monitored.

In another embodiment, interface electronic components can be powered through power lines of the device while a transmission module is powered separately. Separate sources of power for powering the transmission module may include but are not limited to a radio frequency signal received from an antenna with passive transponders or a power line under low-power, independent of power lines of the monitored device. This embodiment separates operation of the transmitter from operation of any remaining parts of the detection unit, in particular of the interface, which can still be powered through power lines of the monitored device and for the period of time during which the power signal powering the device is provided.

This may allow operating parameters to be transmitted even if the monitored device is not powered. Such parameters can be transmitted cyclically and/or upon demand, for example, by following a remote interrogation.

This can be particularly important since it allows effective monitoring systems to be made with small detection units that can be housed within the monitored devices. In some embodiments, the interface and the transmission module are housed within the device while the antenna is placed outside the device, sealing connection elements between the transmission module and the antenna being provided.

According to one embodiment, local units can be set to transmit detected parameters to an intermediate unit interfaced, for example, by a wireless communication network, with a server and/or with portable remote units. The intermediate unit may be arranged remotely with respect to the corresponding detection units and powered independently of the detection units. A communication between the intermediate unit and the detection units can be by a wireless transmission means.

In some embodiments detection units and intermediate units can be connected by a wireless network different from a wireless network for the communication among intermediate units and the server. For example, the wireless network for connection among detection units and intermediate units can include but is not limited to, a WIFI and/or Bluetooth® LAN network or any other known wireless network, while a wireless network for the communication among intermediate units and the server can include, but is not limited to a WAN network such as a GSM, GPRS, EDGE, and/or UMTS network.

In some embodiments, the data collection server may process data collected from intermediate units and make them available to remote stations and can be configured to make them available by internet. The remote stations may include but are not limited to PCs and portable remote units such as palmtop devices and mobile phones.

In some embodiments, portable remote units can be provided and directly interfaced with intermediate units to read raw data as they are detected so that operators in charge of maintenance can be readily warned about each failure. The communication between portable units and intermediate units can use the same wide area network for the communication with the remote server or by Bluetooth® or WIFI, with portable units in which may form a node of the local network.

According some embodiments, intermediate units may compare received data with reference values in order to transmit alarm conditions to the server and/or to portable remote units.

Devices of the disclosure to be monitored can include, but are in no way limited to switch machines of turnouts, signal lamps, and track circuits. Detected operating parameters may comprise one or more electrical operating parameters, for example, current, voltage, and/or power consumption and in case of devices comprising a motor, the position and/or speed of the motor.

With respect to switch machines, if a turnout uses several switch machines that are in synchronization with each other, embodiments of the present disclosure can provide intermediate units to be used in receiving operating parameters of each switch machine of the turnout and to transmit said parameters to the server and/or to portable remote units. In some embodiments there may be one intermediate unit for each turnout.

Embodiments of the present disclosure may allow operation of devices arranged along railway lines to be monitored. These devices may include but are not limited to switch machines of turnouts, signal lamps, and devices for detecting the passage of trains, for example track circuits, and devices which are so-called "wayside" equipment.

FIG. 1 shows the operating principle of the according to some embodiments. The device to be monitored (1) is interfaced with the transmission module (2) intended to receive operating parameters to be monitored and to transmit such parameters to a remote user (3) in a wireless mode. Data transmitted to the user can be as raw or processed data, for example compared with reference operating conditions, in order to produce suitable alarms. In a simple configuration, the user (3) can interface directly to the transmission module (2) for example by means of a portable device, such as a PDA, a mobile phone, a palmtop, a tablet, a notebook, or a portable computer provided with a Bluetooth or WIFI wireless interface. In a more complicated configuration, the system may provide data collected by each transmission module (2) to be sent to a remote server (4) through intermediate circuits (5) acting as a gateway as shown in FIG. 2.

FIG. 1 shows a module or device (1) to be monitored being powered by a corresponding cabinet (6) through power cables (601). This provides an interface and transmission module (2) to be powered by the same power cables (201) of railway device (1). FIG. 1 is just one exemplary embodiment since on the contrary, in another embodiment, the module (2) can be powered also through one or more lines for example from the device (1) provided that at least a part of the electronic components of the transmission module (2) is powered only if the monitored device (1) is powered.

In one embodiment, some circuits, particularly transmission circuits of the transmission module (2) can be independently powered, under low power, such that transmission can occur even when the railway device (1) is not operating. In this case, interface electronic components to the railway device (1) are powered by the power lines powering the railway device (1).

Figure 2:
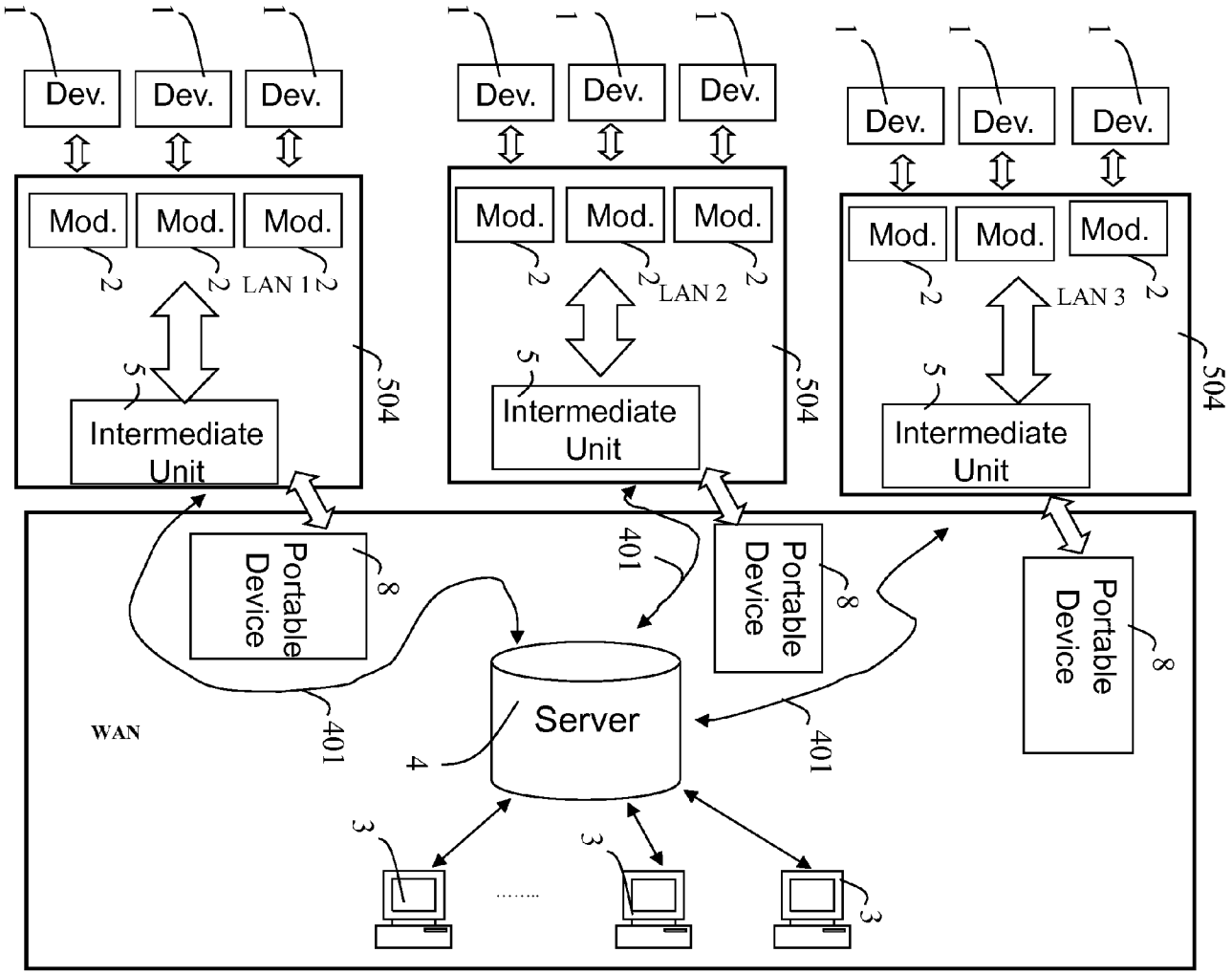
FIG. 2 shows a block diagram of an exemplary embodiment.

With reference to FIG. 2, the system according to the present disclosure comprises several devices (1) to be monitored; each one associated to a corresponding interface and transmission module (2). Each interface and transmission module (2) communicates wirelessly with an intermediate receiving unit (5) providing data to be transmitted to a remote server (4). In the embodiment shown in the figure, several interface and transmission modules (2) communicate with an intermediate unit (5) such to form a local wireless network therewith the intermediate unit (5) being the gateway to a wide area network for the communication among intermediate units (5) of the system and the central server (4).

Figure 3:
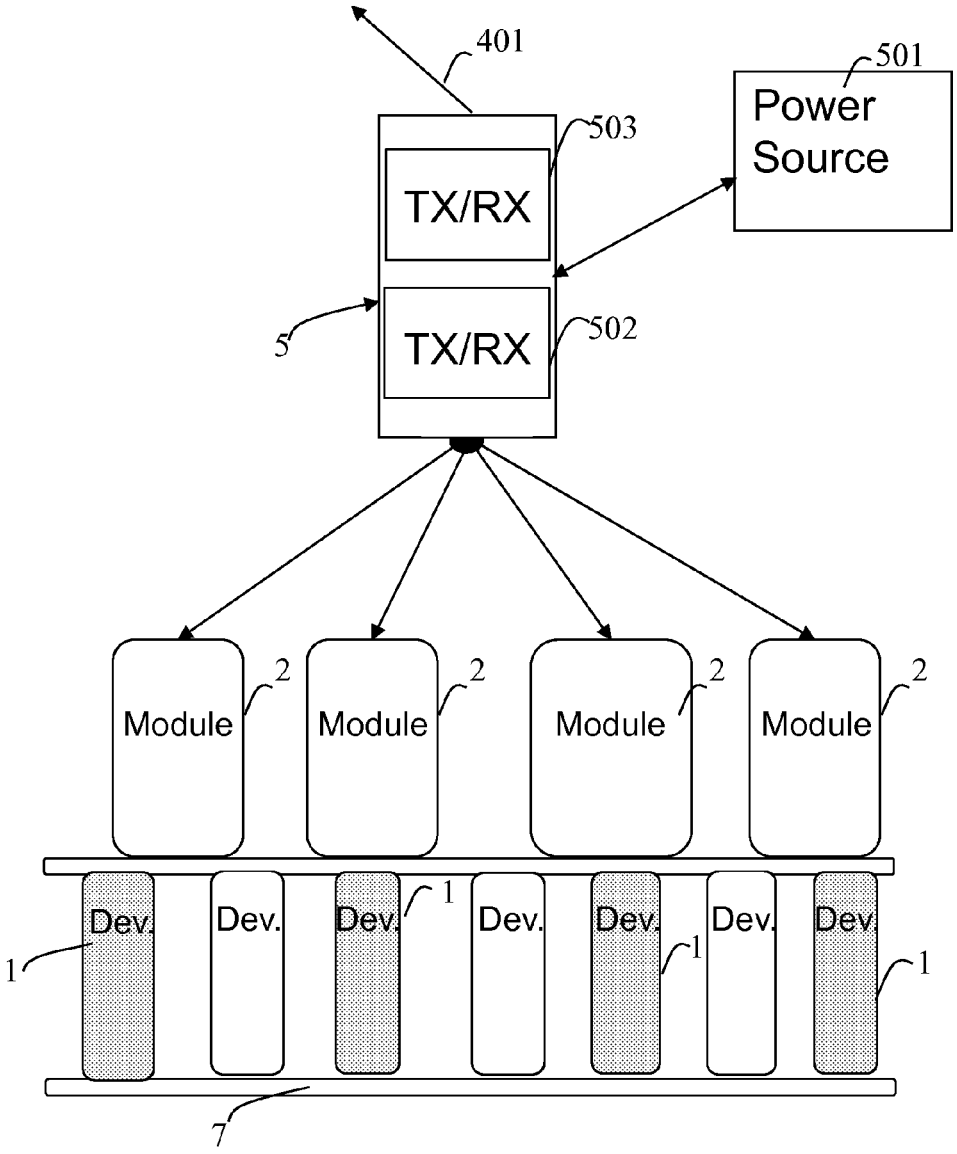
FIG. 3 shows an example of interfacing among four devices arranged along a track portion and a remote server by means of corresponding interface/transmission modules and an intermediate unit serving as a gateway.

FIG. 3 shows an example of how four railway devices (1) are interfaced with a remote data collection server (4) by corresponding interface and transmission modules (2) and an intermediate unit (5) serving as a gateway. In this figure, railway devices (1) are graphically shown as boxes arranged transversally to the tracks (7).

Particularly in high-speed railway lines, turnouts are made with relatively long blades in order to provide a radius of curvature that is wide and proportioned to train speed. Unlike conventional turnouts, where a switch machine is provided in the tip area of blades and a possible switch machine is provided in the area of the so-called frog of the blade, high-speed railroad turnouts have several switch machines arranged along the blades in order keep blades in a proper curved position upon the passage of the train. Embodiments of the present disclosure can provide, in this case, a single intermediate unit (5) to receive operating parameters of all switch machines of the turnout and to transmit said parameters to the server and/or to remote portable units. Thus parameters of each turnout may travel on the same local network and be managed in a uniform and synchronized manner to provide greater monitoring efficiency.

Figure 4:
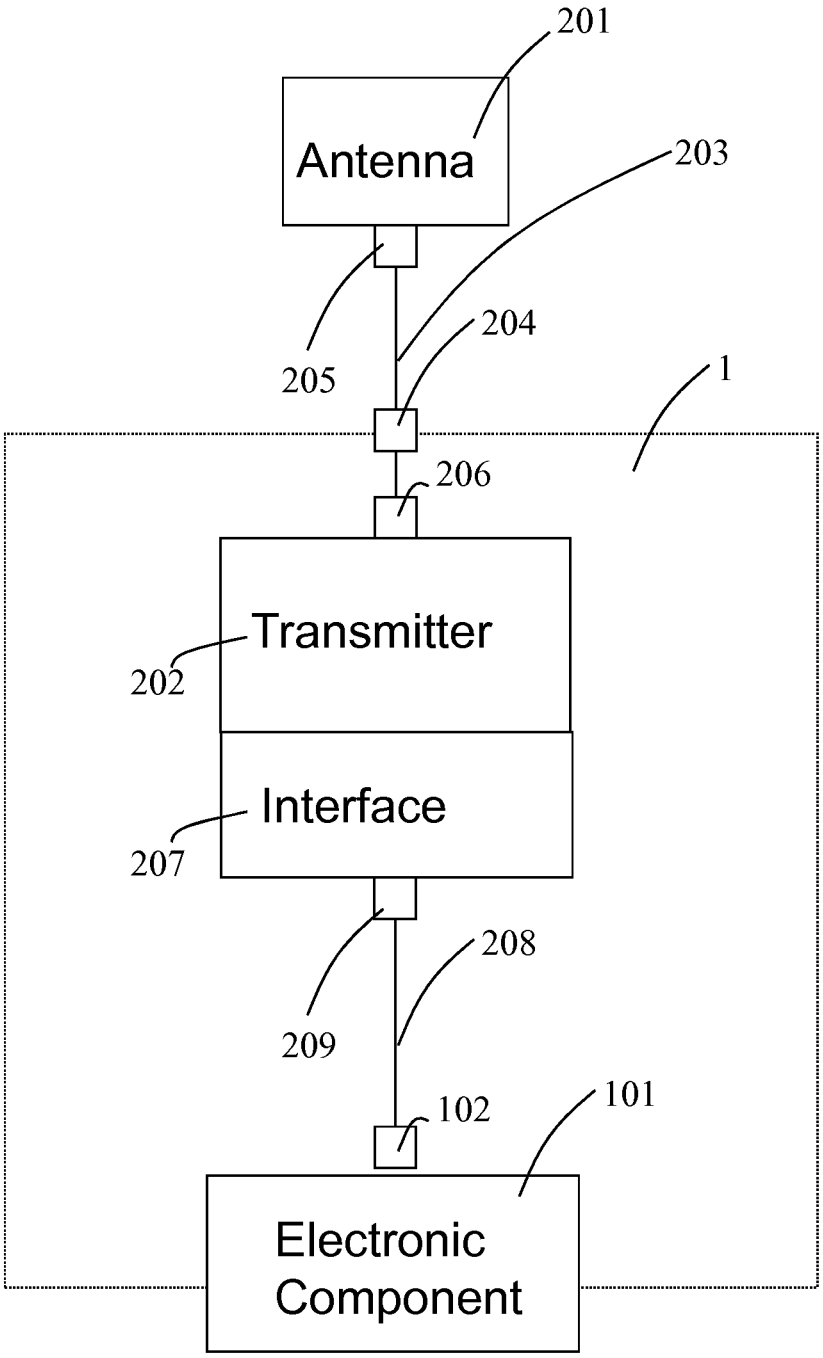
FIG. 4 shows a block diagram of an interface/transmission module placed within a device to be monitored.

FIGS. 2 and 3 show embodiments in which the interface and transmission modules (2) are separated from the corresponding railway device (1). In some embodiments, the modules (2) can be introduced into the device as shown in FIG. 4. In this case only the antenna (201) is arranged outside the railway device to provide a more effective transmission with the intermediate unit (5). Coaxial cable (203) connects the antenna (201) to the transmitter (202) via shielded connectors (205) and (206). The cable gland (204) allows the coaxial cable (203) to pass through a container enclosing the transmission module (1) in a sealed manner.

The transmission module (202) receives the operating parameters of the railway device (1) from the interface (207), the modules being made available by means of electronic components (101). Operating parameters can be electrical parameters, such as voltage, current, and/or power. In case of devices comprising a motor such as switch machines, a further parameter may be the position and/or speed of the motor.

Figure 5:
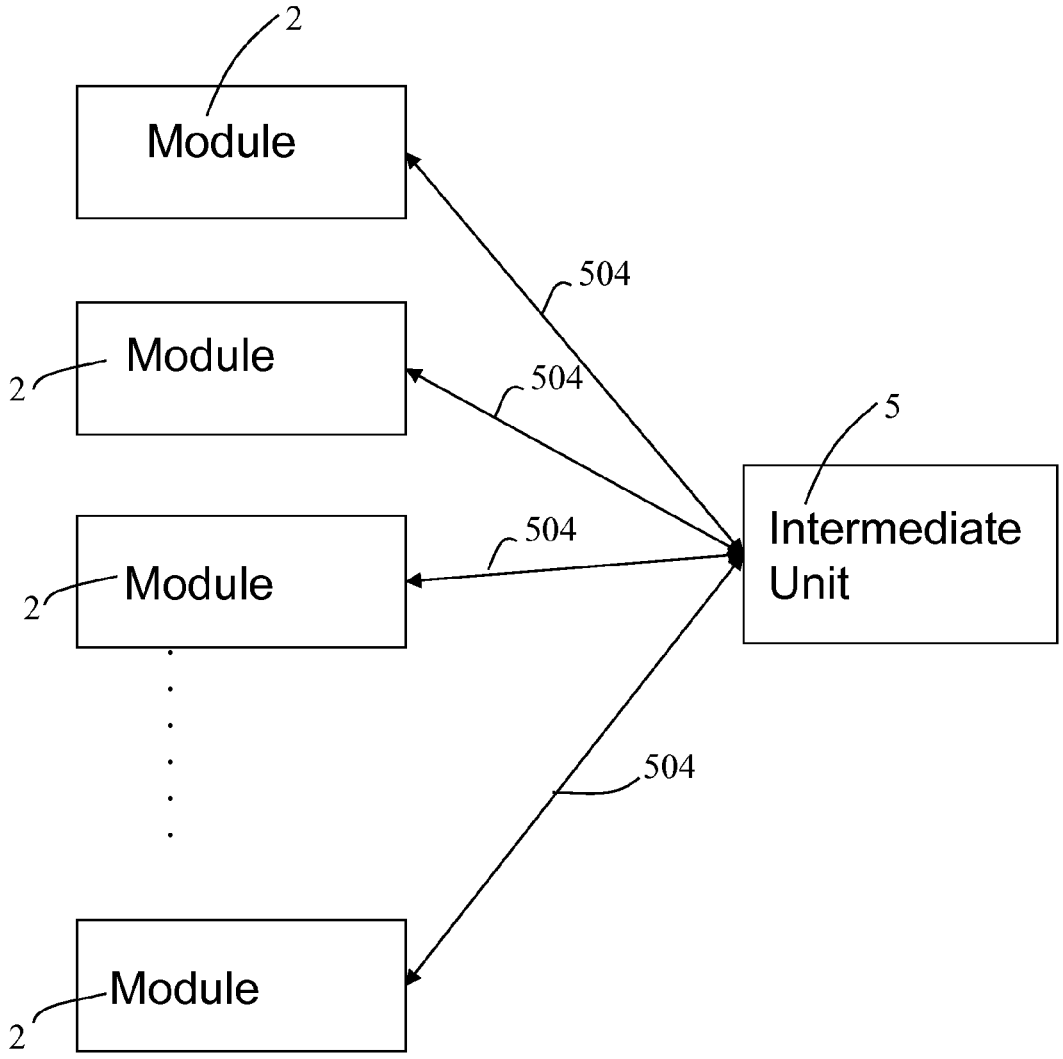
FIG. 5 is exemplary of communication between gateways and interface/transmission modules of FIGS. 1-3.

FIG. 5 shows the interface (207) connected to the electronic components (101) by connection (208) between input port (209) and output port (101). In some embodiments the communication may be a serial RS232 by means of known 9 pin DB-9 cup connectors, but is in no way limited to this type of communication. For example a USB connection or a firewire connection can be used. It is also possible to provide a dedicated connection even with a parallel transmission or on data bus.

The interface (207), in addition to data, may also be configured to receive a power supply from the electronic components (101), for example using power pins of DB-9 connectors. The transmission module (202) may be powered by the interface (207), but it can be also powered independently. In one embodiment the transmission module is a passive transponder receiving power through the antenna in known manners, such as for example described in U.S. Pat. No. 3,713,148. A buffer battery can also be provided which can be recharged when device (1) is in operation. Thus, it is possible to separate the transmission of operating parameters from the reading thereof. For example, a storage element can be provided to be used to store data for a following transmission; such storage element can be, for example, EEprom, a Flash Memory, or a RAM powered by the same buffer battery. In simplest simple case, the transmission module and the interface are powered together such to detect and transmit operating parameters only during a period of time that the device (1) is in operation.

In order to reduce possible interferences, the transmission and/or detection can be concentrated in one or more subintervals of the operation period, for example at the beginning or at the end of a specific operating command. By way of example, a switch machine for turnouts may complete movement within an interval ranging from approximately 3 s to 6 s, therefore the longest operating interval of the detection unit (2) in this specific case is [0, 6], particularly [0, 3] seconds.

The transmission module can also comprise receiving electronic components in case it is necessary to establish a communication protocol to the remote receiving unit, for example by polling. In this configuration however it may not be possible to use this communication channel to send commands to the device since this may affect safety. One of the characteristics the embodiments of the present disclosure is to perform, in a non-vital manner, a simple and inexpensive monitoring of operating parameters of devices without affecting the safety level of railway traffic.

FIG. 4 shows each interface and transmission module (2) connected by a wireless network (504) to an intermediate unit (5) serving as a gateway to the remote server (4), the intermediate unit (5) being powered by an external power source (501) independent of the power source of monitored devices (1). The intermediate unit (5) comprises a wireless transmission/receiving module (502) interfaced with one or more interface and transmission modules (2) and a transmission/receiving module (503) interfaced with the server (4). The intermediate unit (5), may serve as a bridge between two networks: the local network (504) between interface and transmission modules (2) and the wireless transmission/receiving module (503) and the wide area network (401) between the transmission/receiving module (503) and the server (4).

The wide area network (401) is a virtual private network (VPN) using standard infrastructures for telephone or internet communication, for example, including but not limited to GSM, GPRS, EDGE, and UMTS. Since intermediate units (5) may arranged at a short distance (of the order of ten meters) with respect to interface transmission modules (2), the local network (504) can be, on the contrary, a WIFI or Bluetooth network, and in some embodiments even portable devices (8) can be interfaced thereto, such as PDAs, mobile phones, and palmtops belonging to operators in charge of the maintenance which can receive the operating data of a specific device when they enter into a covering area of the corresponding local network.

Intermediate units (5) can send data received from detection units (2) to the server (4), they can perform a series of checks, for example, they may compare data with reference values to send alarm warnings.

The server (4) can receive data from all intermediate units (5) and process historical analysis lists of the operation of each device which are entered into a database available for the remote interrogation, for example by internet.

Users (3) have access to the server in order to verify the history of the operation of each device (1) in order to take corrective actions if malfunctions are detected.

The examples set forth above are provided to give those of ordinary skill in the art a complete disclosure and description of how to make and use the embodiments of the system for monitoring operating functions of railway devices of the disclosure, and are not intended to limit the scope of what the inventors regard as their disclosure. Modifications of the above-described modes for carrying out the disclosure can be used by persons of skill in the art, and are intended to be within the scope of the following claims.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a", "an", and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications can be made without departing from the spirit and scope of the present disclosure. Accordingly, other embodiments are within the scope of the following claims.

What is claimed is:

1. A system comprising:

a railway device;

local detection units coupled to the railway device;

a data collection server; and a wireless network for providing communication between the local detection units and the data collection server, the local detection units configured to monitor operating parameters of the railway device only when the railway device is provided power.

2. The system according to claim 1, wherein the local detection units are configured to operate during a specific phase of operation of the railway device.

3. The system according to claim 1, wherein the local detection units comprise storage elements adapted to store operating parameters and configured to transmit the operating parameters at a set time.

4. The system according to claim 1, wherein the local detection units comprise:

an interface to the railway device;

a transmission module; and and an antenna.

5. The system according to claim 4, wherein the transmission module is powered independently of the interface to the railway device.

6. The system according to claim 4, wherein the transmission module is powered by a radio frequency signal received from the antenna.

7. The system according to claim 4, wherein the transmission module is powered through a low-power power line, independent of power lines powering the monitored-railway device.

8. The system according to claim 4, wherein the transmission module is set to transmit the operating parameters cyclically and/or upon demand, irrespective of the monitored railway device being powered or not powered.

9. The system according to claim 1, wherein the local detection units are interfaced with the monitored railway devices through serial connections.

10. The system according to claim 1, wherein the local detection units are housed within the monitored railway devices.

11. The system according to claim 4, wherein the interface and the transmission module are housed within the monitored railway device while the antenna is placed outside the railway device, sealing connection elements between the transmission module and the antenna.

12. The system according to claim 1, wherein local detection units are set to transmit detected parameters to an intermediate unit, wherein the intermediate unit is communicatively coupled to at least one of the data collection server or a portable remote unit.

13. The system according to claim 12, wherein the intermediate unit is arranged remotely with respect to corresponding detection units, the intermediate unit is powered independently of the detection units, and communication between the intermediate unit and the detection units is wireless.

14. The system according to claim 13, wherein detection units and intermediate units are connected by a wireless network different than the wireless network for communication among intermediate units and the data collection server.

15. The system according to claim 14, wherein the wireless network for the connection among the detection units and the intermediate units is selected from the group consisting of WIFI and Bluetooth® LAN network and the wireless network for the communication among intermediate units and the data collection server is selected from the group consisting of WAN network of GSM, GPRS, EDGE, and UMTS.

16. The system according to claim 1, wherein the remote portable units are directly interfaced to intermediate units through a different wireless network from the wireless network for a connection among local detection units or wherein the remote portable units are directly interfaced to intermediate units through a different wireless network from the wireless network for a connection among local detection units.

17. The system according to claim 1, wherein intermediate units are configured to compare received data with reference values in order to transmit alarm conditions to the data collection server and/or to remote portable units.

18. The system according to claim 1, wherein the data collection server receives data from intermediate units and provides lists of historical analysis of an operation of each railway device to be processed which are entered into a database available for being remotely interrogated.

19. The system according to claim 1, wherein the railway devices to be monitored comprise switch machines of turnouts and detected parameters comprise one or more operating parameters of motors of the switch machines of turnouts, wherein the operating parameters comprise one or more operating parameters selected from the group consisting of: current, voltage, power consumption, position, and speed.

20. The system according to claim 19, comprising several synchronized switch machines of turnouts, an intermediate unit for receiving the operating parameters of each switch machine of the turnouts and for transmitting the operating parameters to the data collection server and/or to the remote portable units.

* * * * *